US008371827B2

(12) United States Patent
Lilie et al.

(10) Patent No.: US 8,371,827 B2
(45) Date of Patent: Feb. 12, 2013

(54) SUSPENSION SYSTEM FOR A LINEAR COMPRESSOR

(75) Inventors: Dietmar Erich Bernhard Lilie, Joinville (BR); Claudio Roberto Hille, Joinville (BR)

(73) Assignee: Whirlpool S.A., São Paulo-Sp (BR)

( * ) Notice: Subject to any disclaimer, the term of this patent is extended or adjusted under 35 U.S.C. 154(b) by 556 days.

(21) Appl. No.: 12/601,585

(22) PCT Filed: May 30, 2008

(86) PCT No.: PCT/BR2008/000162

§ 371 (c)(1),
(2), (4) Date: Mar. 5, 2010

(87) PCT Pub. No.: WO2008/144872

PCT Pub. Date: Dec. 4, 2008

(65) Prior Publication Data

US 2010/0172769 A1 Jul. 8, 2010

(30) Foreign Application Priority Data

May 31, 2007 (BR) ..... 0702461

(51) Int. Cl.
*F04B 39/14* (2006.01)
*F04B 53/22* (2006.01)

(52) U.S. Cl. ..... 417/360; 417/363; 417/416

(58) Field of Classification Search ..... 417/360, 417/363, 416, 902
See application file for complete search history.

(56) References Cited

U.S. PATENT DOCUMENTS

| | | | | |
|---|---|---|---|---|
| 2002/0164255 | A1 * | 11/2002 | Burr et al. | 417/363 |
| 2005/0175473 | A1 * | 8/2005 | Park et al. | 417/363 |
| 2007/0020121 | A1 * | 1/2007 | Halkyard et al. | 417/363 |
| 2007/0020122 | A1 * | 1/2007 | Halkyard et al. | 417/363 |
| 2007/0041856 | A1 * | 2/2007 | Hansen et al. | 417/417 |

FOREIGN PATENT DOCUMENTS

| | | | |
|---|---|---|---|
| GB | 1150915 | A | 5/1969 |
| GB | 1222425 | A | 2/1971 |
| WO | WO-2005028870 | A1 | 3/2005 |
| WO | WO-2006049511 | A2 | 5/2006 |

* cited by examiner

*Primary Examiner* — Devon Kramer
*Assistant Examiner* — Bryan Lettman
(74) *Attorney, Agent, or Firm* — Gifford, Krass, Sprinkle, Anderson & Citkowski, P.C.

(57) ABSTRACT

The suspension system is applied in a compressor, presenting a shell in which interior is horizontally suspended a motor-compressor assembly having opposite ends that are spaced from the shell by an axial spacing. Mounting elements are each attached to an end of the motor-compressor assembly and suspension springs are mounted to the shell and to each respective mounting element. The suspension system comprises stop elements attached to the shell and having a free end portion disposed between a respective end of the motor-compressor assembly and the adjacent suspension spring. A first distance defined between the stop element and the adjacent end of the motor-compressor assembly is smaller than the axial spacing and smaller than a second distance defined between the stop element and an adjacent suspension spring.

21 Claims, 13 Drawing Sheets

SUSPENSION SYSTEM FOR A LINEAR COMPRESSOR

CROSS REFERENCE TO PRIOR APPLICATIONS

This application is a US National Phase Application under 35 U.S.C. §371 of International Patent Application No. PCT/BR2008/000162 filed May 30, 2008, which claims priority to and the benefit of Brazilian Patent Application No. PI0702461-4, filed May 31, 2007, each of which are hereby incorporated by reference in their entireties. The International Application was published in English as WO 2008/144872 A1 on Dec. 4, 2008.

FIELD OF THE INVENTION

The present invention refers to a suspension system to be used in reciprocating compressors driven by a linear motor, in which the fixation of the motor-compressor assembly to the shell is generally carried out through spring elements, particularly flat springs. In a particular way, the present solution refers to an improvement in the suspension system for linear compressors of the type described in patent application WO2006/049511.

BACKGROUND OF THE INVENTION

In a linear motor compressor (FIG. 1), the gas compression mechanism occurs by the axial movement of a piston in the interior of a cylinder provided with a head, in which are positioned the suction and discharge valves which regulate the gas inlet and gas outlet in relation to the cylinder. The piston is driven by an actuator, which carries a magnetic component driven by a linear motor. The piston is connected to a resonant spring and the piston, jointly with the magnetic component and the spring, form the resonant assembly of the compressor.

The compressor is mounted in the interior of a shell which forms a hermetic environment in relation to the exterior thereof and which internally carries a suspension spring assembly, onto which is mounted the compressor. The function of the suspension springs is to minimize the transmission of vibration from the motor-compressor assembly to the shell. The vibrations generated during normal operation of the compressor are produced by oscillation of the mass of the mechanical assembly of the compressor, resulting from the reciprocating movement of the compressor in relation to the motor, said vibrations having a preferential direction and being more accentuated in the movement direction of the piston and less intense in directions orthogonal to this movement direction.

Some of the known prior art solutions for suspending the motor-compressor assembly use: flat springs transversally arranged to the longitudinal axis of the piston (P19902514-0; WO2006/049511) or presenting a balanced suspension system that transmits a minimum of vibration to the compressor shell (EP1301732).

The solution disclosed in WO2006/049511 presents a flat spring, made of steel-sheet, with a determined profile that offers low resistance to the movement in the direction of the gas compression, thus transmitting low vibration to the shell. Besides, this type of spring also has a determined profile that confers a determined deformation resistance, in the directions orthogonal to the piston movement, which is sufficiently high to support the compressor, with little deformation of the flat springs, due to the gravity force acting on the mechanical assembly of the compressor.

The suspension systems with parallel flat springs of the known solutions present a problem related to the great accelerations which occur during handling and transport of the compressors. In these occasions, the relative movement of the mechanical assembly of the compressor in the interior of the shell can be so intense as to cause some parts of said mechanical assembly to impact the inner surface of the shell. Important parts of the compressor can suffer damages during these impacts. Said parts are, for example, the electric motor, the suction chamber, the electrical cables, etc., which may offer risk of accident to the final user, with severe consequences.

Although the suspension system of solution WO2006/049511 minimizes the possibility of occurring the above mentioned impacts of the prior art compressors, the suspension springs, due to their little transversal and lateral flexibility, can break when submitted to great forces, causing damages to the motor-compressor assembly.

SUMMARY OF THE INVENTION

It is a generic object of the present invention to provide a suspension system for a linear compressor, which prevents the impact of the motor-compressor assembly against the shell, particularly preventing the impact of sensitive parts of this assembly against the shell, during operation or transport of the compressor.

It is another object of the present invention to provide a suspension system as cited above, which prevents the suspension springs of said system from breaking.

It is a further object of the present invention to provide a suspension system as cited above, which does not interfere with the attenuation of the vibration generated by the compressor operation and which is obtained with the flat springs of the constructions in which the present solution is applied.

These objects are attained through a suspension system for a linear compressor, presenting: a hermetic shell; a motor-compressor assembly suspended, with its axis horizontally disposed, in the interior of the shell and presenting opposite ends spaced from said shell by an axial spacing; mounting elements, each attached to a respective end of the motor-compressor assembly and axially projecting therefrom; suspension springs mounted to the shell and to each respective mounting element.

According to the invention, the suspension system comprises stop elements, each having a mounting portion rigidly attached to the shell and a free end portion disposed between a respective end of the motor-compressor assembly and the adjacent suspension spring, and a first distance, defined between the stop element and the adjacent end of the motor-compressor assembly, being smaller than said axial spacing and smaller than a second distance defined between the free end portion of the stop element and an adjacent suspension spring.

In accordance with a particular aspect of the present invention, the free end portion of each stop element is provided with a through hole, by which passes, with a radial gap, an extension of a respective mounting element defined between the adjacent end of the motor-compressor assembly and the free end attached to an adjacent suspension spring.

The present invention is mainly applicable to suspension systems using flat springs, preventing them from breaking, but without interfering with their function of dampening the vibrations of the motor-compressor assembly.

BRIEF DESCRIPTION OF THE DRAWINGS

The invention will be described below with reference to the enclosed drawings, in which.

DESCRIPTION OF THE ILLUSTRATED EMBODIMENTS

Figure 1:
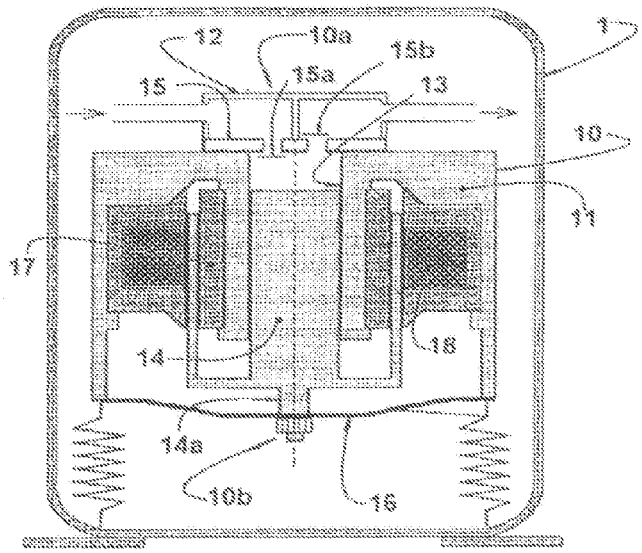
FIG. 1 PRIOR ART
FIGS. 1 and 1A schematically represent longitudinal sectional views of two reciprocating compressors with a linear motor, with their motor-compressor assemblies mounted in the interior of a compressor shell through parallel helical suspension springs, in a vertical mounting arrangement and in a horizontal mounting arrangement, respectively and in accordance with the prior art.

The present invention will be described for a reciprocating hermetic compressor, which comprises, in the interior de a hermetic shell 1, a motor-compressor assembly 10 suspended in the interior of said shell 1 and presenting opposite ends 10*a*, 10*b* spaced from said shell 1.

According to the illustrated figures, the motor-compressor assembly 10 comprises a cylinder block 11 closed, in one end 11*a*, by a cylinder cover 12 and defining, in an opposite end 11*b*, a respective end 10*b* of the motor-compressor assembly 10.

Cylinder block 11 defines a compression cylinder 13, inside which a piston 14, driven by the motor of the motor-compressor assembly 10, is axially displaced during operation of the compressor, in suction and discharge cycles of refrigerant gas. The cylinder 13 has an open end, through which the piston 11 is lodged, and an opposite end, closed by a valve plate 15, against which is externally seated the cylinder cover 12. The valve plate 15 carries at least one discharge valve and, optionally, at least one suction valve, which regulate the gas inlet and gas outlet in the interior of the cylinder 13. In the illustrated construction, the valve plate 15 carries a suction valve 15*a* and a discharge valve 15*b*.

In a particular construction for the compressor of the type driven by a linear motor, the piston 14 is connected to a resonant spring 16 by a rod 14*a*, the piston 14 being axially displaced in the interior of the cylinder 13 by an actuator assembly 17 comprising a magnetic component coupled to the rod 14*a* and axially impelled upon energization of a linear motor 18.

It should be understood that, although the present solution is described for a construction of linear compressor of the illustrated type, such construction should not be limitative of the application of the present solution. In general, the suspension system of the present invention can be applied to other suspension spring constructions, besides that illustrated and described and in which the suspension spring is of the planar type and transversally disposed to the axis of the piston 14.

The motor-compressor assembly comprises mounting elements 20, each projecting from one of the two opposite ends 10*a*, 10*b* of the motor-compressor assembly 10, and suspension springs 30, each mounted to the shell 1 and to a respective mounting element 20.

In the illustrated construction, each mounting element 20 is defined by at least one rigid rod 21, 22 attached to the motor-compressor assembly, each rigid rod having a free end 21*a*, 22*a* axially projecting from a respective end 10*a*, 10*b* of the motor-compressor assembly 10.

The motor-compressor assembly 10 incorporates, in a single piece or by fixation, from each of its opposite ends 10*a*, 10*b*, at least one mounting element 20.

Figure 1A:
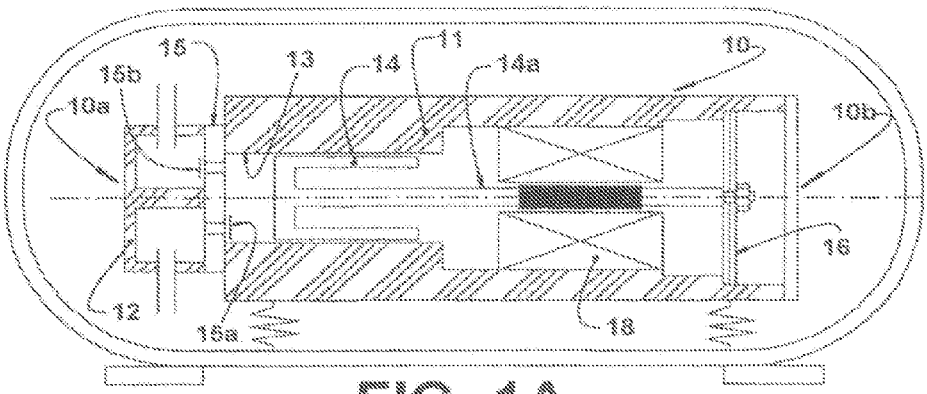
FIG. 1A PRIOR ART

In the prior art construction in which the compressor is driven by a linear motor, as illustrated in FIGS. 1 and 1A, the motor-compressor assembly 10 is suspended in the interior of the shell 1, by suspension means in the form of helical suspension springs 30, inferiorly disposed in the interior of the said shell 1. This construction presents the previously discussed deficiencies.

Figure 2A:
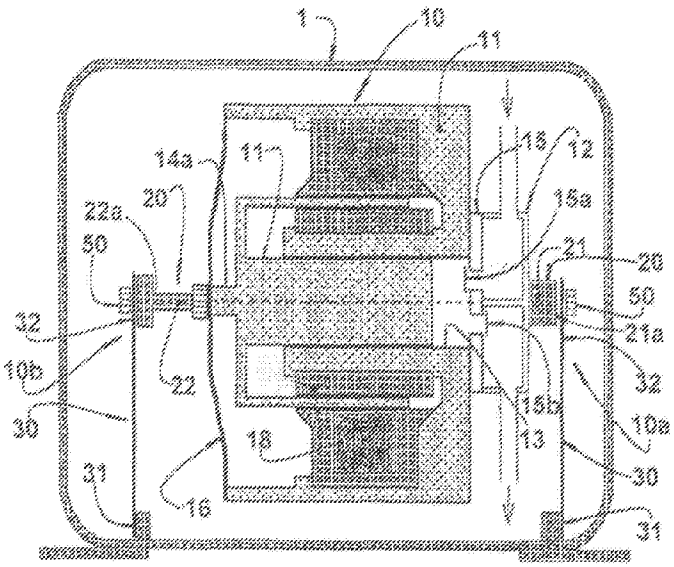
FIG. 2A PRIOR ART
FIGS. 2 and 2A schematically represent longitudinal sectional views of two compressors with a linear motor, with their motor-compressor assemblies mounted in the interior of a compressor shell through parallel flat suspension springs, in a vertical mounting arrangement and in a horizontal mounting arrangement, respectively and in accordance with the prior art.
Figure 2:
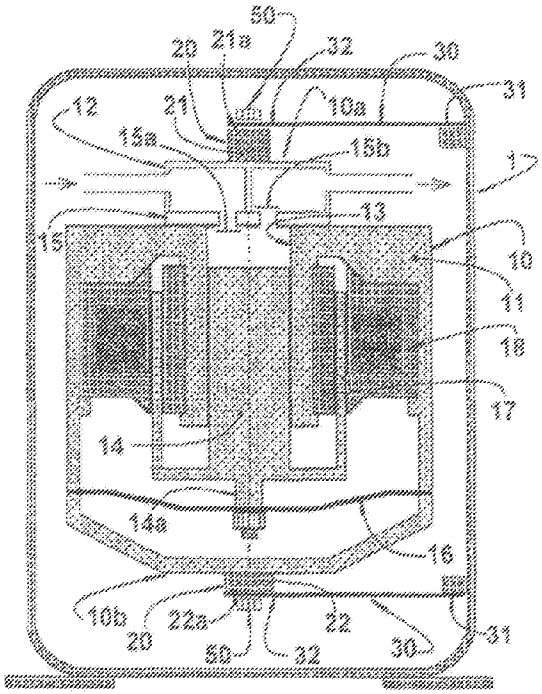
FIG. 2 PRIOR ART
Figure 3:
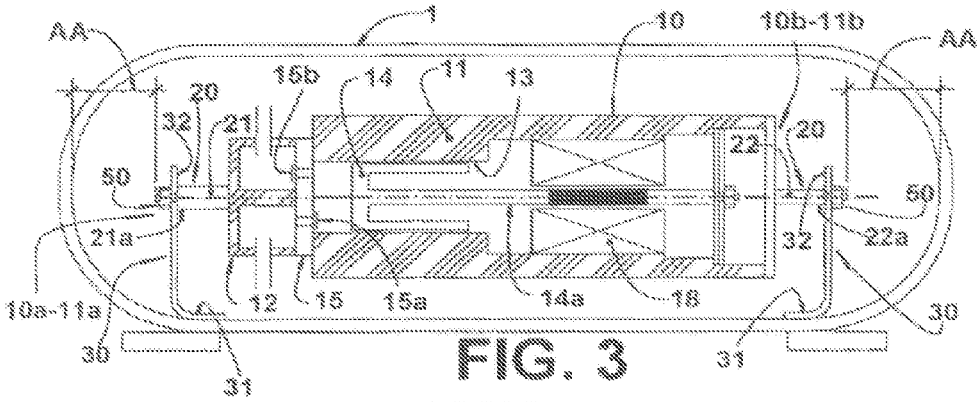
FIG. 3 PRIOR ART
FIG. 3 represents, such as in FIG. 2*a*, a longitudinal sectional view of a linear compressor mounted in the interior of the shell, in a horizontal mounting arrangement of the motor-compressor assembly, using another prior art construction of flat suspension springs.

In the construction of the compressor illustrated in FIGS. 2, 2*a* and 3, the mounting of the motor-compressor assembly 10 in the interior of the shell 1 occurs through a suspension means comprising two flat suspension springs 30, each presenting a fixation portion 31 and a movable portion 32, extended from the fixation portion 31 and through which it is mounted and affixed to the motor-compressor assembly 10.

The fixation portion 31 and movable portion 32 define, in a single piece, a respective flat spring, which is obtained, for example, in the form of a flexible plate, such as a metallic blade, for example, with a reduced thickness in the displacement direction of the piston 14 and presenting a determined flexibility.

Figure 4:
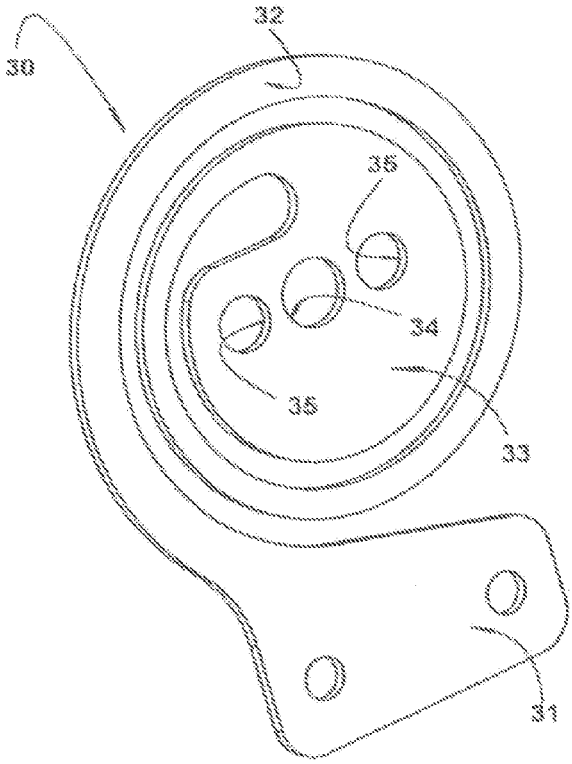
FIG. 4 PRIOR ART
FIG. 4 represents a perspective view of the construction of flat suspension spring used in FIG. 3 and of the type described in patent application WO2006/049511.
Figure 5:
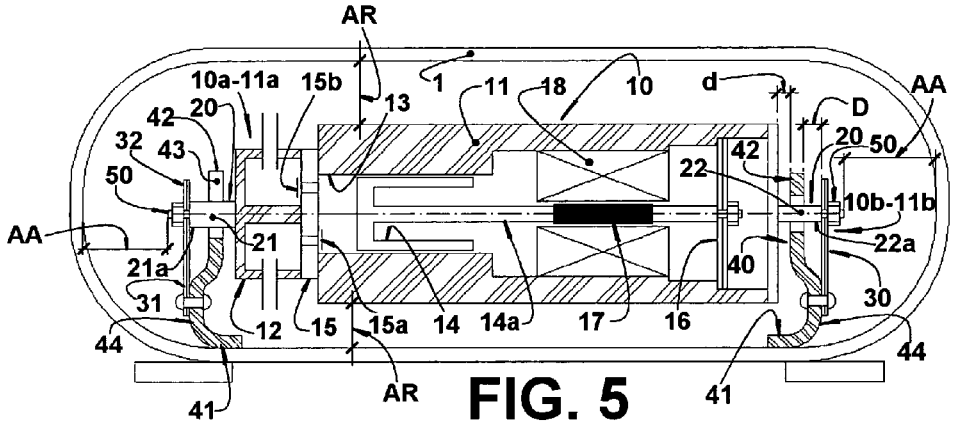
FIG. 5 represents a sectional view similar to that of FIG. 3, illustrating a compressor with a linear motor horizontally disposed and provided with the suspension system object of the present invention.
Figure 6:
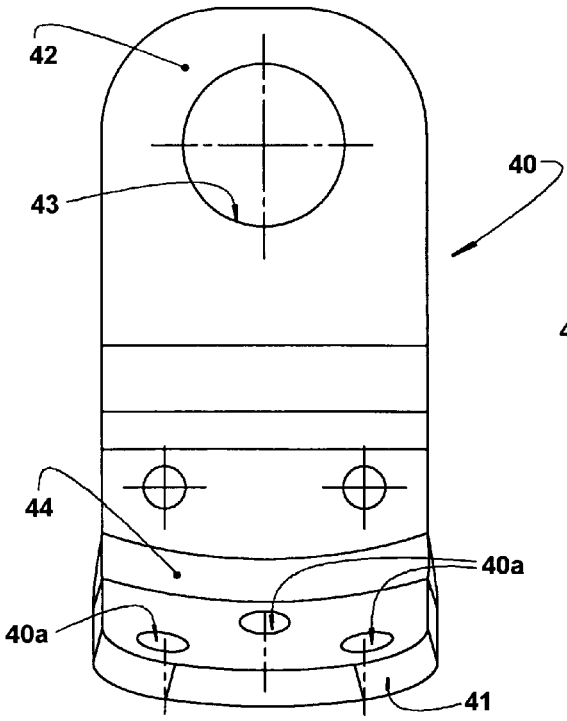
FIGS. 6, 6A and 6B schematically and respectively represent a front view, a detail in an enlarged longitudinal sectional view of the stop element of the present invention, and a detail in an enlarged longitudinal sectional view of said stop element mounted in the shell of a refrigeration compressor.
Figure 6A:
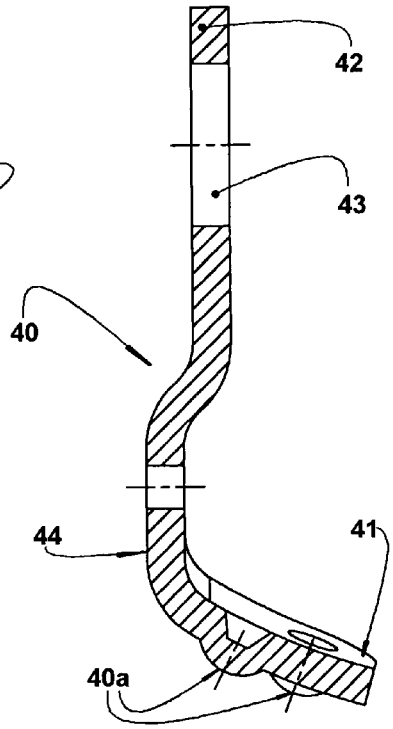
Figure 6B:
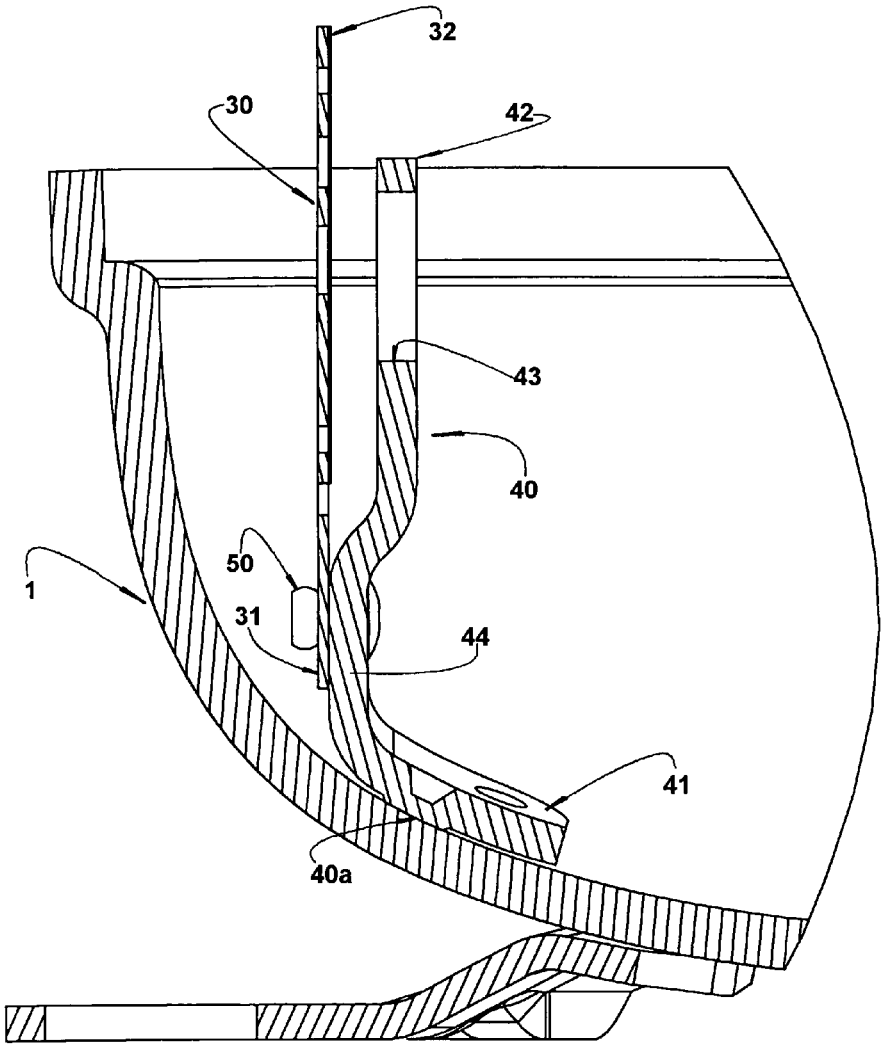
Figure 7:
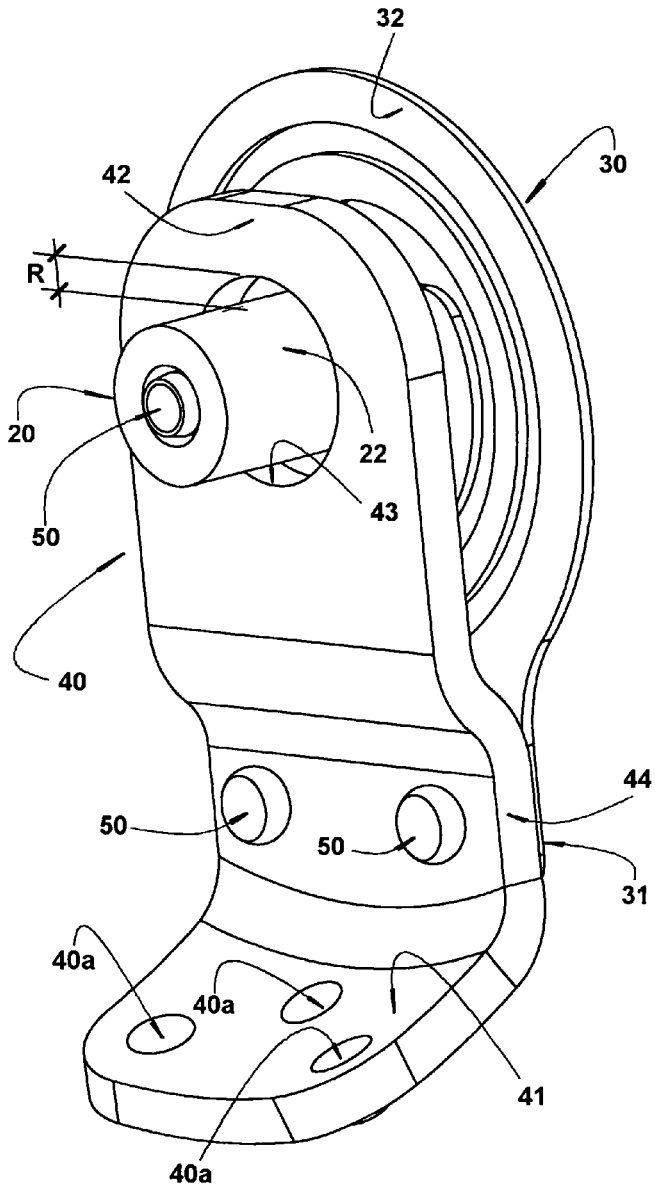
FIGS. 7 and 7A schematically and respectively represent a perspective view and a longitudinal sectional view of the stop element illustrated in FIGS. 6 and 6A, further illustrating the mounting element, the suspension spring and the adjacent end of the cylinder block.
Figure 7A:
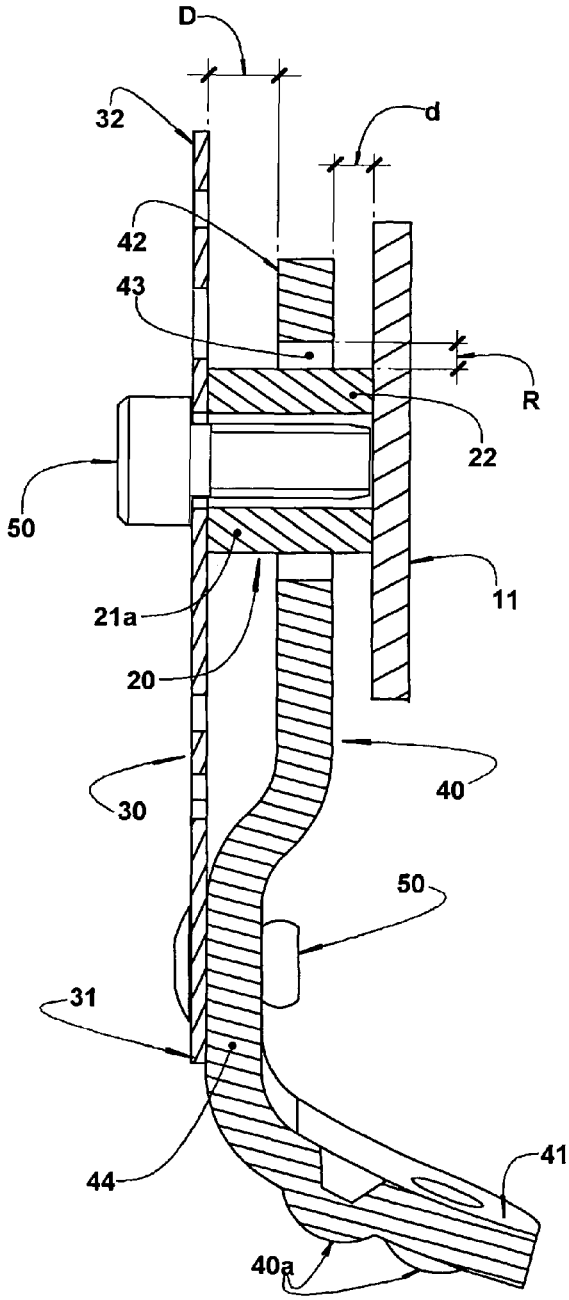
Figure 8:
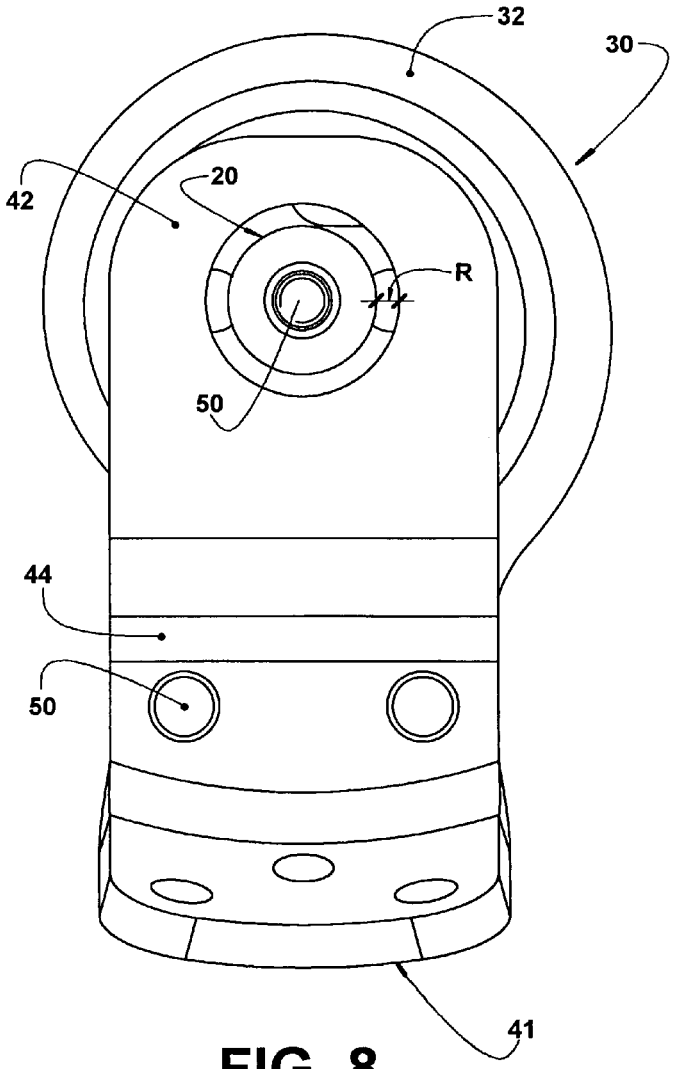
FIG. 8 represents an elevational end view of the set of components illustrated in FIGS. 7 and 7A.

In a known constructive form (FIG. 4), the flat spring presents its movable portion 32 in the form of a coil, initiating its curvature, in an increasing development, from a central portion 33 of said movable portion 32, through which the flat spring is attached to the motor-compressor assembly 10. The central portion 33 presents at least one hole, for example, a central hole 34, to receive an end 21*a*, 22*a*, of a rigid rod 21, 22, for fixation of the motor-compressor assembly 10. In the illustrated construction, the central portion 33 of at least one flat suspension spring 30 further presents a pair of other holes, in the form of eccentric holes 35, for fixation of the cylinder cover 12 to the suspension spring 30. In this construction, the rigid rod 21 is attached to the cylinder cover 12 through two fixation means, each mounted through an eccentric hole 35 of the suspension spring 30, aligned to a respective blind hole provided in the rigid rod 21 of the cylinder cover 12. This mounting defines, in the motor-compressor assembly 10, two points for supporting the latter to the shell 1, which act together with another support point defined close to the opposite end of said motor-compressor assembly 10, in order to prevent the motor-compressor assembly 10 from rotating around its longitudinal axis, in the interior of the shell 1. The two support points defined close to the cylinder cover 12 of the motor-compressor assembly 10 are laterally provided and equally spaced in relation to the axis of the rigid rod which defines, in the illustrated construction, a single support point close to the opposite end of the motor-compressor assembly 10. It should be understood that multiple support points can be provided between the opposite ends 10*a*, 10*b* of the motor-compressor assembly 10 and the suspension springs 30.

In a construction with two fixation points, these can be defined by the provision of two rigid rods, each presenting a respective blind hole. In the case of a plurality of support points, the mounting element comprises a set of rigid rods that are laterally adjacent and project from the part that carries them.

In another possible construction, such as that illustrated herein, the rigid rod presents two eccentric blind holes parallel to each other, each to be aligned with an eccentric hole of an adjacent suspension spring 30. In this construction, in which the rigid rod 21 projects from the cylinder cover 12, said rigid rod 21 presents a non-circular cross section, for example, substantially rectangular, having a determined width in one of the vertical or horizontal directions substantially inferior to a length taken in the other of said directions. In the illustrated construction, the width of the rigid rod 21 is taken in the vertical direction, said width being substantially inferior to a length taken in the horizontal direction. In this case, the construction of the rigid rod 21 may present, such as illustrated, an oblong profile.

In the construction in which the mounting element 20 has a rigid rod with two blind holes, the fixation portion 31 of an adjacent suspension spring 30 is provided with two eccentric holes 35 for the passage of fixation means such as, for example, screws, which attach the suspension spring 30 to the cylinder cover 12 of the motor-compressor assembly 10.

In this construction, the suspension springs 30 present lateral and transversal flexibility and a sufficiently high rigidity to support the motor-compressor assembly 10 in the interior of the shell 1.

The suspension system of the present invention is applied to a motor-compressor assembly 10 mounted in the interior of the shell 1, with its axis horizontally disposed so that the opposite ends 10*a*, 10*b* of said motor-compressor assembly 10 are spaced from an adjacent wall portion of the shell 1, by an axial spacing AA, taken according to said longitudinal axis.

The present suspension system comprises stop elements 40, each having a mounting portion 41 rigidly attached to the shell 1, and a free end portion 42, provided between a respective and adjacent end 10*a*, 10*b* of the motor-compressor assembly 10 and an adjacent suspension spring 30.

Each stop element 40 is mounted at a first distance d, in relation to the adjacent end 10*a*, 10*b* of the motor-compressor assembly 10, smaller than a second distance D defined between the free end portion 42 of the stop element 40 and an adjacent suspension spring 30. The distance d to mount the stop element 40 in relation to the adjacent end 10*a*, 10*b* must be also smaller than the axial spacing AA between each of said end 10*a*, 10*b* and the shell 1.

While the suspension system is provided mainly to prevent impacts between the motor-compressor assembly 10 and the shell 1, the first distance d between each stop element 40 and the adjacent end 10*a*, 10*b* of the motor-compressor assembly 10 is calculated in order that, in case an end 10*a*, 10*b* of the motor-compressor assembly 10 seats against the adjacent stop element 40, when axially displaced in this direction, said seating occurs before the adjacent mounting elements 20 and suspension spring 30 hit a confronting wall portion of the shell 1 and before the movable portion 32 of the opposite suspension spring 30 reaches the free end portion 42 of the adjacent stop element 40. In other words, the first distance d between each opposite end 10*a*, 10*b* of the motor-compressor assembly 10 and the free end portion 42 of the adjacent stop element 40 is smaller, not only in relation to the second distance D, but also in relation to the axial spacing AA between each mounting element 20 and a confronting wall portion of the shell 1.

Each suspension spring 30 is attached to a respective stop element 40, through appropriate fixation means 50, such as screw, rivet, welding, etc., and each stop element 40 is attached to the shell 1 through respective appropriate fixation means, such as welding or gluing.

In a way of carrying out the present invention, each stop element 40 comprises, adjacent to the respective mounting portion 41, at least one lower projection 40*a*, generally produced by deformation, to be electrically welded (by projection) to the inner surface of the shell 1.

In the illustrated construction, the mounting portion 41 of each stop element 40 is defined by an end portion of said stop element 40, opposite to the free end portion 42. In this case, the second distance D between the free end portion 42 of the stop element 40 and the movable portion 32 of the adjacent suspension spring 30 is obtained by dimensioning a support portion 44 carried by an adjacent mounting portion 41 of each stop element 40, each of said support portion 44 attaching, through an adequate fixation means 50, such as welding, screw, rivet, etc, the fixation portion 31 of a suspension spring 30.

The support portion 44 is preferably conformed to be defined in a parallel or substantially parallel plane and spaced from a plane containing the free end portion 42 of the respective stop element 40, by a value corresponding to the second distance D, taken in the mounting region of a respective suspension spring 30. In the illustrated construction, the support portion 44 is incorporated, in a single piece, to the respective stop element 40, during obtention thereof. It should be understood that the support portion 44 can be defined in a separate piece adequately attached to the stop element 40.

In the constructions in which each stop element 40 is obtained by stamping, the support portion 44 is defined by deforming the piece being conformed. In the illustrated construction, the deformation is in the form of a curvature provided in the mounting portion 41.

According to a way of carrying out the present invention (not illustrated), the free end portion 42 of at least one of the stop elements 40 is positioned in order that the adjacent mounting element 20 is disposed externally to the contour of said free end portion 42. In this case, the radial retention of the mounting element 20 is made exclusively by the structure of the adjacent suspension spring 30.

In the constructions in which there is less freedom of movement of the motor-compressor assembly 10 in the directions transversal to the axis of the piston 14, such as in the illustrated solution, the free end portion 42 of each stop element 40 is provided with a through hole 43, through which a respective mounting element 20 is lodged and retained against displacements orthogonal to the axis of the motor-compressor assembly 10. Each mounting element 20 has a portion of its extension, defined between the adjacent end 10*a*, 10*b* of the motor-compressor assembly 10 and the movable portion of an adjacent suspension spring 30, lodged in a through hole 43 with a radial gap R inferior to the elastic deformation admitted for the suspension spring 30, in a direction orthogonal to the axis of the motor-compressor assembly 10 and inferior to a radial spacing AR between the motor-compressor assembly 10 and the shell 1. This radial gap R can be variable around the respective mounting element 20, although the constructions illustrated and described below present a constant radial gap R around each mounting element 20.

In accordance with a constructive form, the stop element 40 presents a through hole 43 centrally produced in the free end portion 42 of a respective stop element 40, and which is conformed to entirely surround, with the radial gap R, an extension of the adjacent mounting element 20. In a not illustrated way of carrying out the present invention, one of the stop elements 40 has the respective free end portion 42 provided with a through hole 43, as already described, and which entirely surrounds, with the radial gap R, an extension of the mounting element 20 projecting from an adjacent end of the cylinder block 11.

According to a way of carrying out the present invention, at least one of the stop elements 40 presents its through hole 43 partially surrounding, with the radial gap R, an extension of the mounting element 20, said through hole 43 presenting an open contour and being provided with a radial slot 43*a* open outwardly from the respective stop element 40, to allow an extension of the adjacent mounting element 20 to be radially fitted in its interior.

According to the illustrated embodiment of the invention, the stop elements 40 used for mounting the motor-compressor assembly 10 within the shell 1, present different constructions, particularly as to the free end portion 42, one of said constructions having the respective through hole 43 with a closed contour and the other presenting the respective through hole 43 with an open contour and defining a radial slot 43*a*, as exposed above.

The constructions in which the free end portion 42 presents a through hole 43 promote a retention of each respective mounting element 20, in the displacing direction of the piston 14 and in directions transversal to said displacing direction of the piston 14, which retention is sufficient to avoid deforming and possibly breaking the adjacent suspension spring 30, by vibration of the motor-compressor assembly 10, and to prevent the motor-compressor assembly 10 from oscillating in said transversal directions.

In accordance with the present invention, in order to prevent transversal oscillations which approximate the motor-compressor assembly to the walls of the hermetic shell 1, the stop elements 40 are resistant to pulling and compression forces and present a certain flexibility in the displacing direction of the piston 14, which is sufficient to absorb part of the impact energy when the adjacent end of the motor-compressor assembly 10 is seated against said piston 14.

In the illustrated constructions for the stop elements 40, the free end portions 42 thereof are different from one another, and they are constructed according to mounting requirements of the adjacent end of the cylinder block 11.

In order to mount the suspension spring 30 to an end of the cylinder block 11, adjacent to the resonant spring 16, the through hole 43 is defined so as to entirely surround, with a radial gap, an extension of an adjacent mounting element 20.

In a particular form of this construction, the mounting element 20 is in the form of a rigid rod 22, of circular cross section, which coaxially traverses a through hole 43, which entirely surrounds and with the radial gap R, said rigid rod 22. In the illustrated construction, the through hole 43 is in the form of a central through hole, with a closed and also circular contour.

The mounting of the motor-compressor assembly 10 to this stop element 40 occurs by passing, through a through hole 43 centralized in the respective stop element 40, a mounting element 20, until reaching a central hole 34 of an adjacent suspension spring 30. In these constructions, an end 22*a* of a rigid rod 22, defining the mounting element 20, can traverse also the central hole 34, receiving a fixation means 50 which retains said rigid rod 22 to said suspension spring 30. In another possible construction, the end 22*a* is also provided with a hole to be aligned with the central hole 34 of the suspension spring 30, in order to receive an extension of the fixation means 50.

For mounting the stop element 40 to the end 10*a* of the motor-compressor assembly 10 adjacent to the cylinder cover 12, the suspension system of the present invention provides said stop element 40 with its through hole 43 partially surrounding, and with the a radial gap R, an extension of the adjacent mounting element 20, said through hole 43 presenting an open contour and being provided with a radial slot 43*a* open outwardly from the stop element 40, so as to allow an extension of the adjacent mounting element 20 to be radially fitted in its interior.

For mounting a suspension spring 30 to the other end of the cylinder block 11, particularly to the cylinder cover 12 thereof, the mounting element 20 is defined by a rigid rod 21, having a respective free end 21*a* axially projecting from the cylinder cover 12, said rigid rod 21 and through hole 43 each presenting a respective non-circular cross section, for example, substantially rectangular. In this constructive option, the through hole 43 presents a substantially rectangular contour having a vertical width Lv inferior, preferably substantially inferior, to a horizontal length Ch, and the radial slot 43*a* presents a horizontal width Lh inferior to the horizontal length Ch of the respective through hole 43.

In this construction, the mounting element 20 presents a cross section having a horizontal dimension slightly inferior to the horizontal length Ch of the through hole 43 and superior to the horizontal width Lh of the radial slot 43*a* and to the vertical width Lv of the through hole 43, said dimensions being defined to allow the mounting element 20 to be radially fitted in the interior of the through hole 43, in a position angularly displaced in relation to a final mounting position, in which said mounting element 20 remains radially retained in the interior of the through hole 43.

Although a construction in which the vertical width Lv is smaller than the horizontal length Ch has been illustrated, it should be understood that, within the concept presented herein, constructions with a vertical width Lv superior or even substantially superior to the horizontal length Ch are possible.

For this construction, the mounting element 20 may be also defined by a pair of laterally adjacent rigid rods. The mounting of the motor-compressor assembly 10 in the interior of the shell 1 occurs after attaching, to said shell 1, the stop elements 40 duly positioned therewithin and at least one suspension spring 30 being attached to each stop element. With the stop elements 40 and suspension springs 30 already positioned, the motor-compressor assembly 10 is mounted by disposing, through the through hole 43 of one of the stop elements 40, the rigid rod 22 adjacent to the resonant spring 16, until its end 22*a* reaches the adjacent suspension spring 30 and is attached thereto. In the constructions in which the stop elements 40 are different from one another, the first stop element 40 to be traversed by a mounting element 20 is the one whose through hole 43 has a closed contour.

With this arrangement already defined, the motor-compressor assembly 10 is subjected to a small rotation around its longitudinal axis, until the rigid rod 21, which defines the other mounting element 20, is introduced, slightly inclined, through the radial slot 43*a* of the through hole 43 of the other stop element 40, and reaches the interior of said through hole 43. Then, said rigid rod 21 is conducted to a horizontal position, orthogonal to the longitudinal axis of the adjacent stop element 40, receiving, in this position, fixation means 50, such as screws, for attaching the adjacent suspension spring 30 to the cylinder block 11.

Figure 9A:
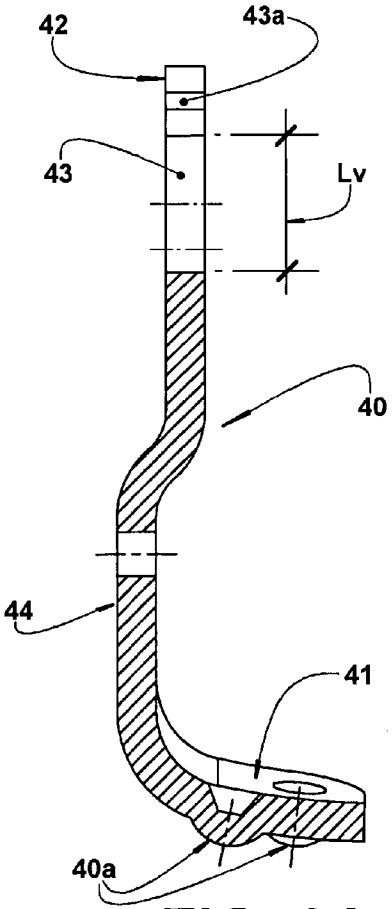
FIGS. 9 and 9A schematically and respectively represent a front view, a detail in an enlarged longitudinal sectional view of another construction for the stop element of the present invention, to be used close to the cylinder cover of the motor-compressor assembly.
Figure 9:
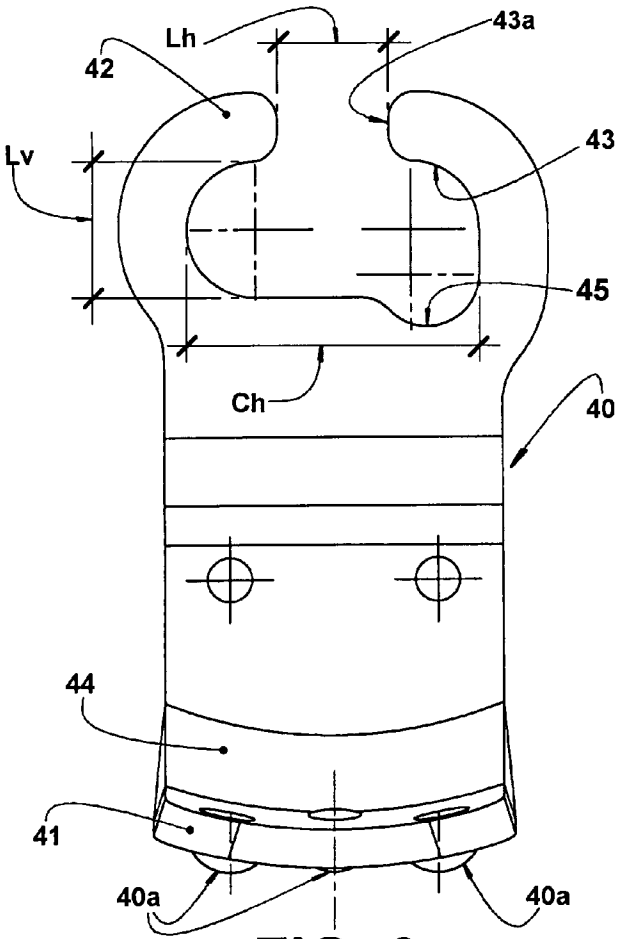
Figure 10:
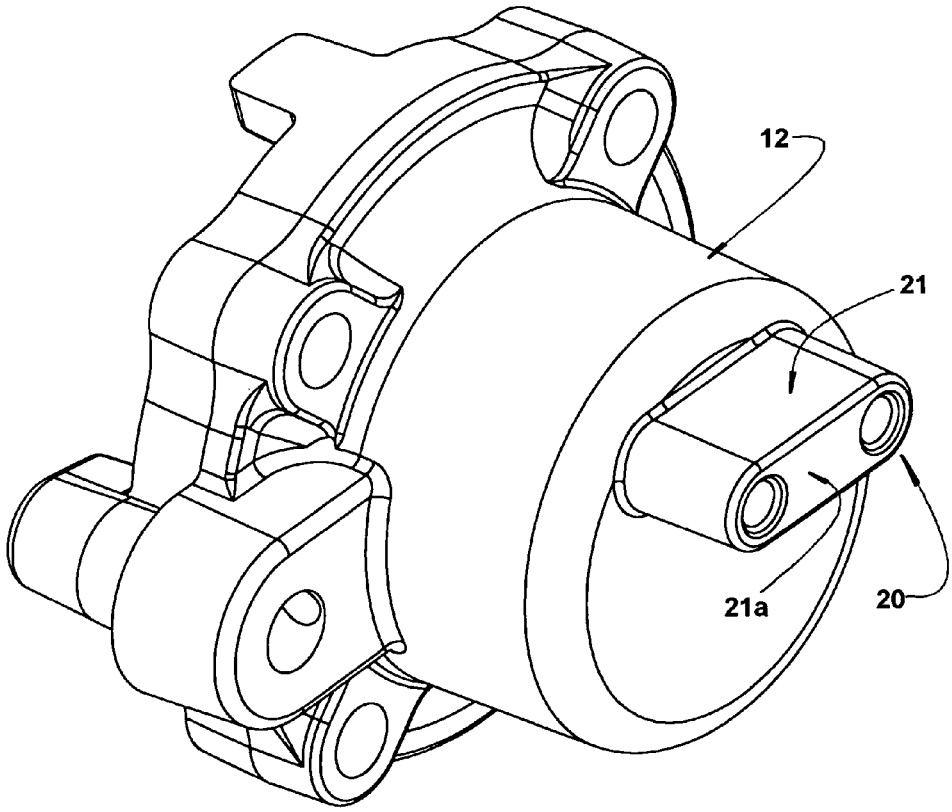
FIG. 10 schematically represent a perspective view of a cylinder cover, near which is mounted the stop element illustrated in FIGS. 9 and 9A.
Figure 11:
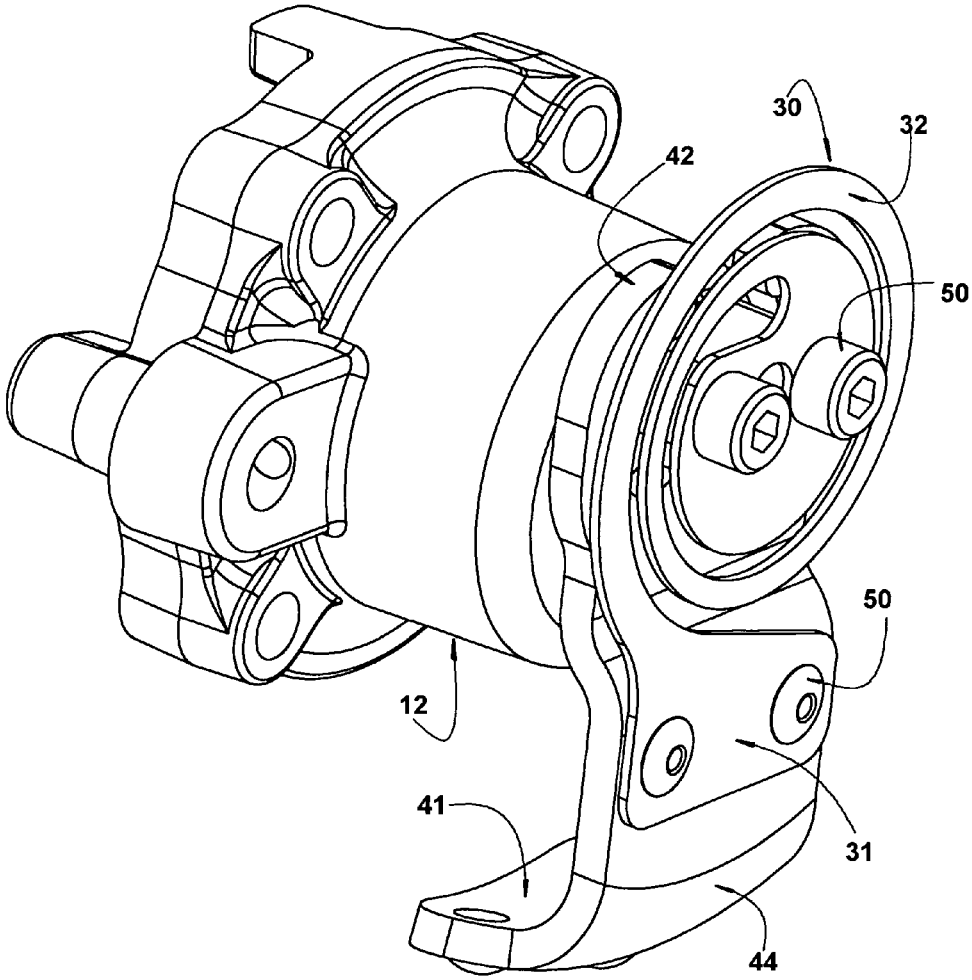
FIGS. 11 and 11A schematically represent a perspective view and a longitudinal sectional view of an assembly formed by the cylinder cover and by the respective mounting element, suspension spring and stop element illustrated in FIGS. 9 and 9A.
Figure 11A:
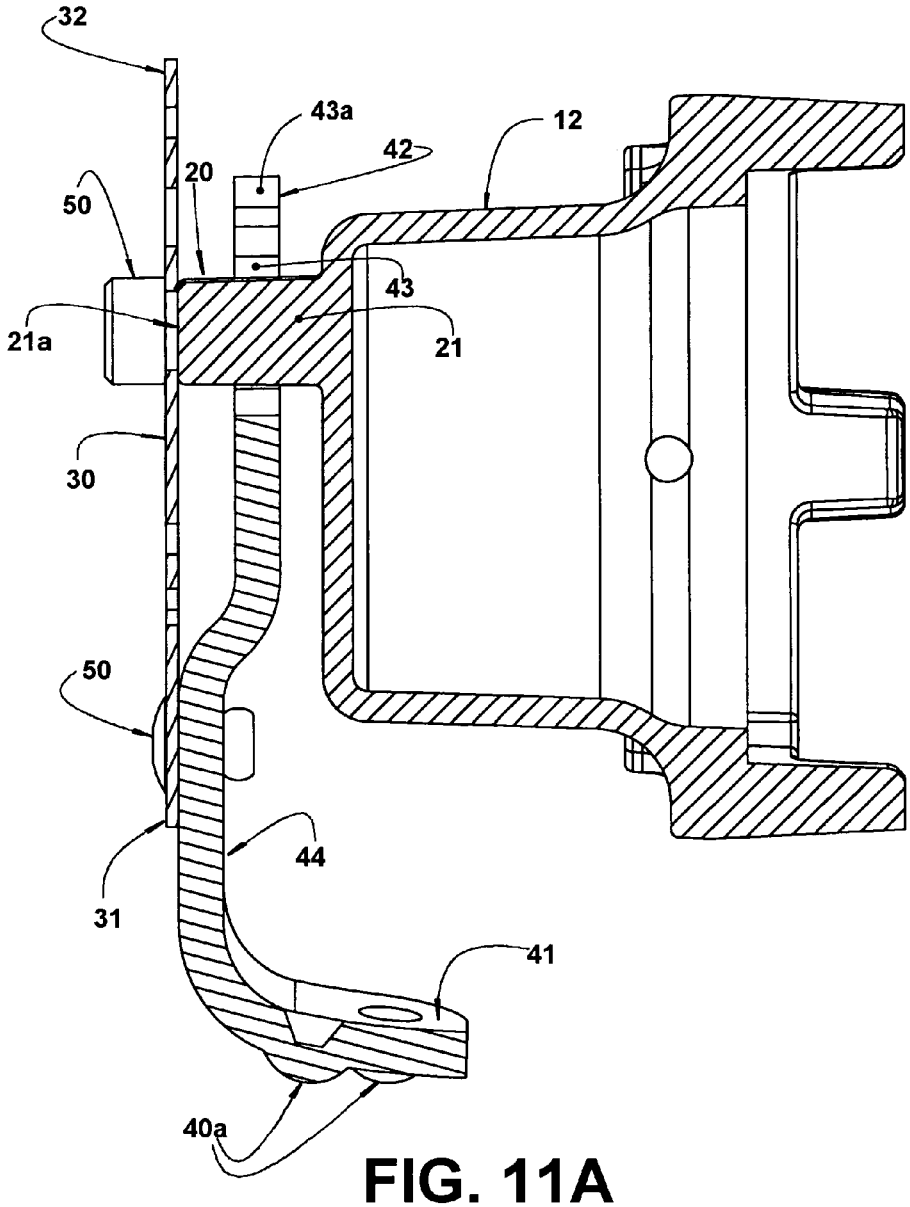
Figure 13:
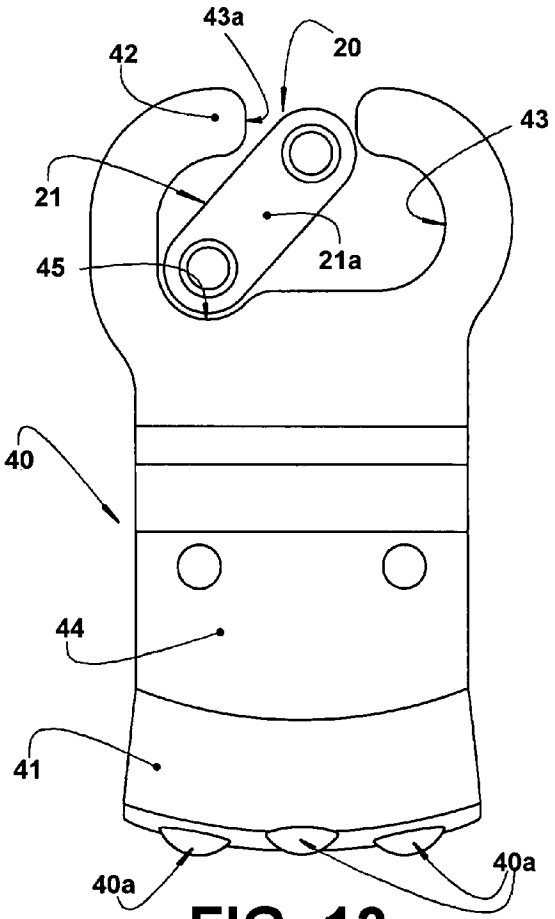
FIG. 13 represents an elevational end view of the stop element illustrated in FIG. 12, but with the motor-compressor assembly turned about 45° around its axis, to allow the adjacent mounting element to assume an intermediary mounting position in the stop element.
Figure 12:
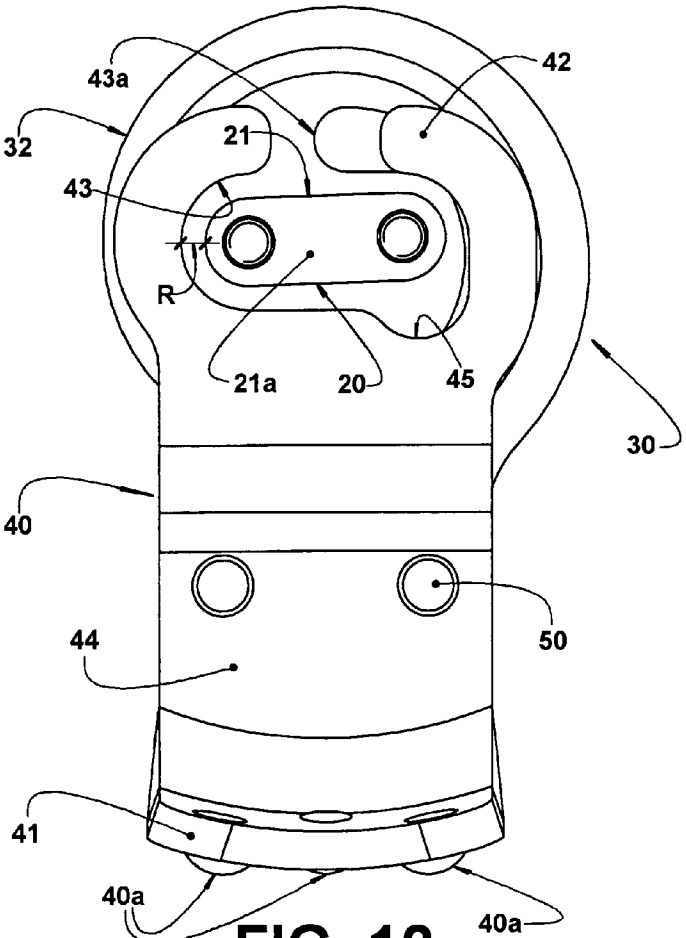
FIG. 12 represents an elevational end view of the assembly illustrated in FIG. 11A.

In order to facilitate introducing and moving this rigid rod 21 in the interior of the adjacent stop element 40, the through hole 43 thereof presents, in its contour, at least one recess 45, eccentric to its radial slot 43*a* and which is dimensioned to accommodate a lateral edge of the mounting element 20, during the initial phase in which the latter is radially fitted in the interior of the through hole 43. The recess 45 is produced in an inner wall portion of the through hole 43, as illustrated in FIGS. 9, 12 and 13.

The open end portion 42, of each stop element 40 has the respective through hole 43 conformed so that the passage of an extension portion of each rigid rod 21, 22, through the respective through hole 43, occurs with a radial gap R which does not provoke any type of interference upon normal operation of the compressor, but which provides displacement limiting means for the motor-compressor assembly 10, at least in the compressor transport and handling situations.

The suspension system of the present invention has the advantages of: preventing the motor-compressor assembly 10 from striking the shell 1; preventing the excessive deformation of the springs in the direction orthogonal to the axis of the motor-compressor assembly 10; protecting the suspension springs 30 against break, by avoiding impacts thereof against the shell 1 and also against the stop elements 40. Besides, the suspension system of the motor-compressor assembly 10 of the present invention presents the advantage of having low cost and being easy to be manufactured, since the stop elements 40 are in the form of a stamped piece, being affixed by already widely known conventional fixation processes.

The present invention is also applicable to the constructions in which, on each side of the motor-compressor assembly 10, is mounted a suspension spring or even a plurality of suspension springs 30, defining a leaf spring assembly. In this case, the suspension system of the present invention permits providing a stop element 40 of the type presented herein for each suspension spring 30 of the leaf spring assembly, or also a single stop element 40 for each suspension leaf spring assembly disposed on each side of the motor-compressor assembly 10 and adjacent to a suspension spring 30 provided closer to the motor-compressor assembly 10.

Each plurality of suspension springs 30 can have at least part of their suspension springs 30 mounted to the shell 1 directly to the latter or through the stop elements 40 disposed on the same side of the motor-compressor assembly 10, or said suspension springs 30 can be mounted to a common portion, which is then mounted to the stop element 40.

In this case in which the plurality of suspension springs 30 are provided on each side of the motor-compressor assembly 10, it is obtained a dampening effect, which prevents undesirable resonances from occurring and, consequently, high noise levels. Besides, the present invention permits providing a dampening tape adhered to each suspension spring 30 to create the same effect.

The invention claimed is:

1. A suspension system for a linear compressor comprising:

a hermetic shell;

a motor-compressor assembly which is suspended, with a longitudinal axis thereof horizontally disposed, in an interior of the shell and having opposite ends spaced from said shell by an axial spacing;

mounting elements, each attached to a respective end of the motor-compressor assembly and axially projecting therefrom; and suspension springs mounted to the shell and to a respective mounting element, wherein the system comprises stop elements, each having a mounting portion rigidly attached to the shell and a free end portion disposed between one of the respective ends of the motor-compressor assembly and an adjacent suspension spring, and a first distance, defined between the stop element and an adjacent end of the motor-compressor assembly, being smaller than said axial spacing and smaller than a second distance defined between the free end portion of the stop element and the adjacent suspension spring.

2. The system, as set forth in claim 1, wherein the free end portion of each stop element is provided with a through hole, by which a respective mounting element is lodged and retained against displacements orthogonal to the longitudinal axis of the motor-compressor assembly.

3. The system, as set forth in claim 2, wherein the through hole of one of the stop elements entirely surrounds and with a radial gap, an extension of an adjacent mounting element.

4. The system, as set forth in claim 3, wherein the radial gap is inferior to an elastic deformation admitted for the suspension spring, in a direction orthogonal to the longitudinal axis of the motor-compressor assembly and inferior to a radial spacing between the motor-compressor assembly and the shell.

5. The system, as set forth in claim 4, in which the motor-compressor assembly comprises a cylinder block closed, in one end, by a cylinder cover and defining, in an opposite end, one end of the motor-compressor assembly, wherein the mounting element is defined by a rigid rod having a respective free end axially projecting from the end of the cylinder block opposite to the cylinder cover.

6. The system, as set forth in claim 3, wherein the mounting elements are defined by a rigid rod presenting a circular cross section, and the through hole, which surrounds said rigid rod, presents a closed circular contour.

7. The system, as set forth in claim 3, wherein at least one stop element presents its through hole partially surrounding and with a radial gap, an extension of the mounting element, said through hole having an open contour and being provided with a radial slot open outwardly from the stop element, so as to allow an extension of the adjacent mounting element to be radially fitted therewithin.

8. The system, as set forth in claim 7, wherein the radial gap is inferior to an elastic deformation admitted for the suspension spring, in a direction orthogonal to the longitudinal axis of the motor-compressor assembly and inferior to a radial spacing between the motor-compressor assembly and the shell.

9. The system, as set forth in claim 8, in which the motor-compressor assembly comprises a cylinder block closed, in one end, by a cylinder cover and defining, in an opposite end, one end of the motor-compressor assembly, wherein the mounting element is defined by a rigid rod having a respective free end axially projecting from the cylinder cover, said rigid rod and through hole each presenting a respective non-circular cross section.

10. The system, as set forth in claim 7, wherein the through hole resents a substantially rectangular contour having a vertical width, substantially inferior to a horizontal length.

11. The system, as set forth in claim 10, wherein the radial slot has a horizontal width inferior to the horizontal length of the through hole, the respective mounting element having a horizontal dimension inferior to the horizontal length of the through hole and superior to the horizontal width of the radial slot and to a vertical width of the through hole, in order to allow said mounting element to be radially fitted in the interior of the through hole, in a position angularly displaced in relation to a final mounting position, in which it remains radially retained in the interior of the through hole.

12. The system, as set forth in claim 7, wherein the through hole presents, in its contour, a recess, eccentric to its radial slot which is dimensioned to accommodate a lateral edge of the mounting element during an initial phase in which the latter is radially fitted in an interior of the through hole defined in an inner wall portion of the through hole.

13. The system, as set forth in claim 2, wherein each suspension spring is attached to the shell through the mounting portion of an adjacent stop element.

14. The system, as set forth in claim 13, in which each suspension spring has a fixation portion to attached to the shell, wherein each stop element presents, in a respective mounting portion, a support portion which is attached the fixation portion of the adjacent suspension spring.

15. The system, as set forth in claim 14, wherein the support portion is defined in a plane spaced from a plane containing the free end portion of a respective stop element, by a value corresponding to said second distance.

16. The system, as set forth in claim 15, wherein the support portion is defined in a single piece with the respective stop element.

17. The system, as set forth in claim 1, wherein each suspension spring is attached to the shell through the mounting portion of an adjacent stop element.

18. The system, as set forth in claim 17, in which each suspension spring has a fixation portion to attached to the shell, wherein each stop element, in a respective mounting portion, a support portion in which is attached the fixation portion of the adjacent suspension spring.

19. The system, as set forth in claim 18, wherein the support portion is defined in a plane spaced from a plane containing the free end portion of a respective stop element, by a value corresponding to said second distance.

20. The system, as set forth in claim 19, wherein the support portion is defined in a single piece with a respective stop element.

21. The system, as set forth in claim 1, wherein the suspension springs are flat springs, each having a respective fixation portion to be attached to the shell, and a movable portion to be attached to the motor-compressor assembly.

* * * * *